US006152086A

United States Patent [19]

Brouwer et al.

[11] Patent Number: 6,152,086

[45] Date of Patent: Nov. 28, 2000

[54] HEATING APPARATUS AND METHOD FOR OPERATION THEREOF

[75] Inventors: Johan Derk Brouwer, Elburgerweg; Wim Benschop, Parklaan; Paulus Albertus De Bruin, Achillesstraat, all of Netherlands

[73] Assignee: Cooperatieve Inkoopvereniging, Coopra-Rotterdam, Netherlands

[21] Appl. No.: 09/101,121

[22] PCT Filed: Nov. 3, 1997

[86] PCT No.: PCT/EP97/06179

§ 371 Date: May 3, 1999

§ 102(e) Date: May 3, 1999

[87] PCT Pub. No.: WO98/20287

PCT Pub. Date: May 14, 1998

[51] Int. Cl.[7] ..... F22B 21/26

[52] U.S. Cl. ..... 122/249; 122/33; 122/250 R

[58] Field of Search ..... 122/31.1, 33, 132, 122/244, 245, 246, 249, 250 R, 367.3

[56] References Cited

U.S. PATENT DOCUMENTS

| | | | |
|---|---|---|---|
| 3,477,412 | 11/1969 | Kitrilakis | 122/33 |
| 3,522,909 | 8/1970 | Arant | 122/33 |
| 4,131,084 | 12/1978 | Hanson et al. | 122/33 |
| 4,222,350 | 9/1980 | Pompei et al. . | |
| 4,299,194 | 11/1981 | Miller | 122/33 |
| 4,823,557 | 4/1989 | Bottum, Jr. et al. | 62/238.6 |
| 5,687,678 | 11/1997 | Suchomel et al. | 122/25 OR |

FOREIGN PATENT DOCUMENTS

| | | |
|---|---|---|
| 0385700 | 9/1990 | European Pat. Off. . |
| 0570201 | 11/1993 | European Pat. Off. . |
| 8530184 | 5/1986 | Germany . |
| 9213594 | 3/1993 | Germany . |
| 7606031 | 12/1976 | Netherlands . |

*Primary Examiner*—Pamela Wilson
*Assistant Examiner*—Gregory A. Wilson
*Attorney, Agent, or Firm*—Ostrolenk, Faber, Gerb & Soffen, LLP

[57] ABSTRACT

Apparatus for heating fluid, comprising a first supply for supplying fuel, a second supply for supplying oxidizing agent, a burner for combusting fuel and oxidizing agents after mixing thereof and a first heat exchanger to be heated by flue gases of the burner and arranged belically round the burner.

17 Claims, 8 Drawing Sheets

HEATING APPARATUS AND METHOD FOR OPERATION THEREOF

BACKGROUND OF THE INVENTION

Heating appliances with an improved efficiency (IE) and high efficiency (HE) are in large scale use in the Netherlands and elsewhere for heating dwellings and other accommodation areas. For many dwellings it is important that such heating appliances take the most compact possible form, while it must be avoided that the appliances are so complicated that regular, costly servicing and maintenance has to take place.

These known heating appliances have a number of drawbacks, a number of significant ones being: the size of the appliances, whereby they are difficult to build into a cupboard or the like; the emission of CO and $NO_x$ as well as the associated efficiency loss, for instance because considerable temperature differences are present inside the apparatus.

SUMMARY OF THE INVENTION

The present invention provides an apparatus for heating fluid, comprising:

first supply means for supplying fuel;

second supply means for supplying oxidizing agent;

burner means for combusting fuel and oxidizing agents after mixing thereof; and a first heat exchanger to be heated by flue gases of the burner means and arranged helically round the burner means.

A heating appliance is obtained with the present invention which can be embodied compactly and wherein emissions and efficiency loss are limited.

Preferred embodiments of the apparatus relate to further improvements in efficiency and reduction in emission of undesired combustion products by precise guiding of the combustion products along the heat exchanger.

A jacket provided with openings is preferably arranged round the helical heat exchanger in order to enable a good heat exchange between the combustion gases and the pipes of the heat exchanger. These openings can be round or slot-shaped and are preferably arranged behind the helically running pipe of the heat exchanger. The jacket may also be formed from wound strips or band of metal between which openings are left clear.

In a so-called combi-appliance is included an insulated tank or reservoir of relatively small dimensions from which hot tap water is immediately available. A compact combi-appliance with a power of for instance 22–24 kW has to be capable of providing 6 liters of water per minute at 60° C. from this insulated storage tank. In the known combi-appliances however, it is found in practice that, while water at 60° C. is supplied for a short time, the temperature of the tap water thereafter decreases and a constant value above 60° C. is reached only after for instance one minute. This is particularly the case if the heating appliance is not used or is used to a lesser extent (as according to so-called modulating operation) to heat fluid in pipes and radiators of the heating system in the dwelling. Although a preferred embodiment of the present invention is provided with such a reservoir, another preferred embodiment is provided with a heat exchanger which takes up little space.

The present invention further provides an apparatus which is provided with a reservoir for temporarily storing heated water, wherein the reservoir comprises a second heat exchanger which is operationally coupled to the first heat exchanger.

The first heat exchanger will preferably be provided in the future with an inner pipe and an outer pipe, whereby the tap water is further heated in the inner pipe.

The apparatus according to the present invention is preferably provided with a third heat exchanger which is arranged in the discharge duct for the heated flue gases and which serves to preheat the tap water.

The preferred embodiment with a reservoir is preferably provided with pump means for pumping medium round in the heating circuit provided with a rotation speed regulation, or at least an ON/OFF control, wherein the pump action is reduced or interrupted at the moment wherein hot water is demanded from the hot water reservoir by the user, or immediately thereafter, whereby, in the case the apparatus is not used for heating purposes, the relatively cold water from the first heat exchanger is prevented from entering the reservoir. If necessary, the burner is started and the first heat exchanger heated, whereafter the pumping action of the pump means is increased.

The flue gases are preferably urged closely along the first heat exchanger for exchange of heat between the flue gases and the heat exchanger with the greatest possible efficiency, wherein for this purpose the side walls of the annular space preferably have a contour at least partially adapted to the outer contour of the heat exchanger in order to further increase a laminated gas flow along the heat exchanger.

As well as for room heating, thermal energy is also required in a dwelling for a number of other purposes, for instance for cleaning, such as hot air for a tumble dryer or dish washer and the like, and also for cooking and the heating of ventilation air for circulation in a dwelling. This thermal energy is generated in most dwellings using electricity, which is disadvantageous from an energy efficiency viewpoint.

The present invention therefore further proposes to provide the above stated apparatus with a heat exchanging unit which is arranged in heat-conducting contact with the top part of the apparatus and which is provided with an inlet for infeed of medium for heating and an outlet for heated medium.

BRIEF DESCRIPTION OF THE DRAWINGS

Further advantages, features and details of the present invention will be elucidated on the basis of the following preferred embodiments thereof with reference to the annexed drawings, in which.

DETAILED DESCRIPTION OF PREFERRED EMBODIMENTS

Figure 1:
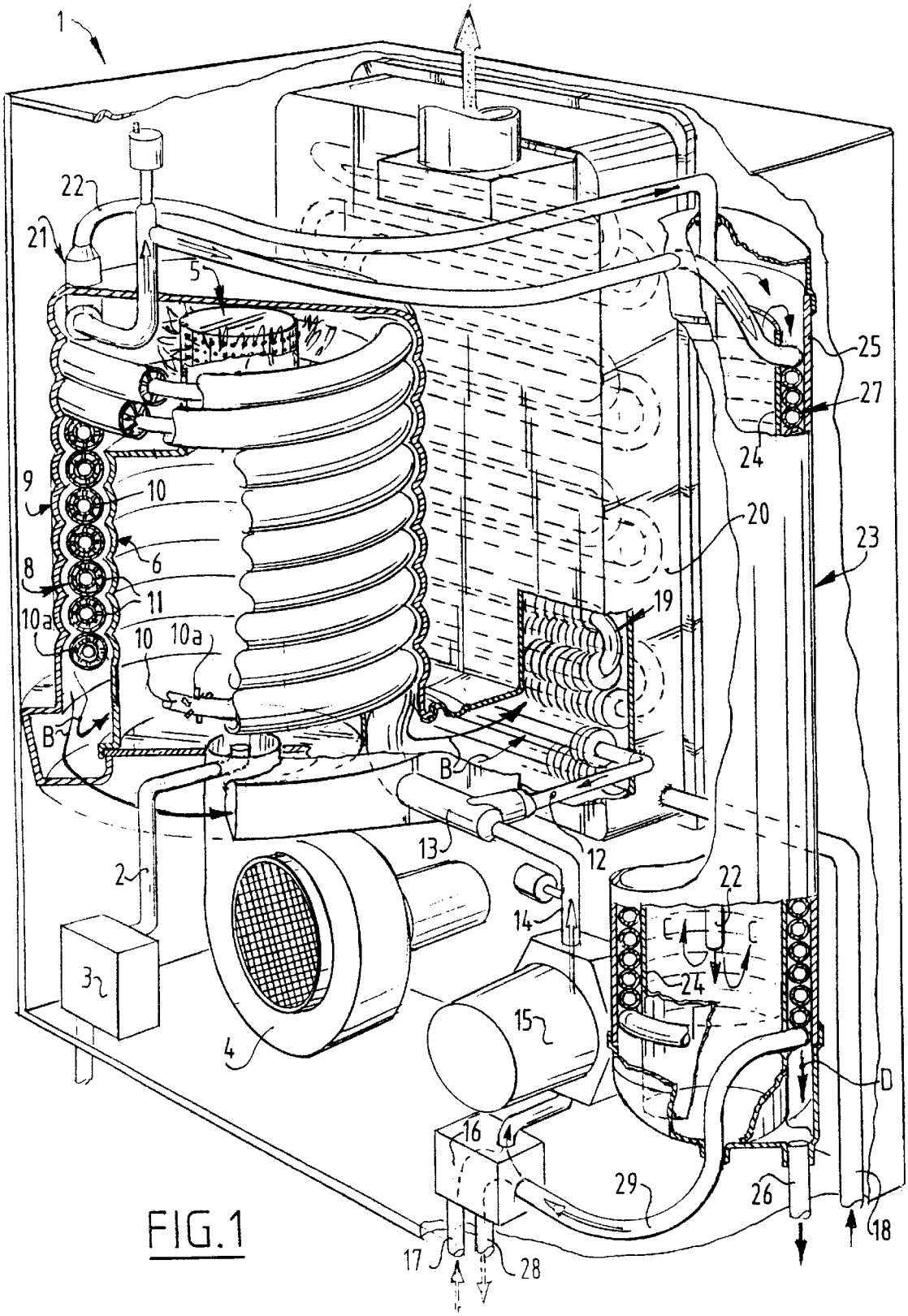
FIG. 1 shows a partly cut-away view in perspective of a preferred embodiment of an apparatus according to the present invention.

A heating apparatus 1 (FIG. 1) comprises a feed line 2 for gas with a schematically designated gas regulation 3 in addition to a schematically designated fan 4 for feed of air to a burner 5 where the gas is mixed with the air and combusted. The gas and the air are mixed in a substantially hollow cylindrical inner sleeve 6 which may be provided with mixing means (not shown) and which is provided with openings which debouch in a combustion space around which a heat exchanger 8 is disposed, which space is enclosed by a substantially cylindrical outer sleeve 9 closed at the top. The gases are deflected in downward direction and guided along heat exchanger 8 between the outer wall of inner sleeve 6 and the inner wall of outer sleeve 9. Both the inner wall of outer sleeve 9 and the outer wall of inner sleeve 6 are preferably adapted slightly in shape to the annular pipes of heat exchanger 8 so that a good heat exchange takes place between the hot gases and the content of the heat exchanger.

The helical heat exchanger 8 preferably comprises an inner pipe 10 and an outer pipe 11. Arranged on the inner pipe for good heat transfer are star-shaped fin parts 10*a* which make heat-conducting contact with outer pipe 11. Flowing through inner pipe 10 is so-called tap water which can be drawn off as hot water in a household using a tap and which is supplied via a pipe 12. Tap water pipe 12 ends at connecting piece 13 onto which also connects a supply line 14 which, via a three-way valve 16 and a pump 15, connects onto the circuit of a central heating system via a feed line 17 and a discharge line 28.

In the present embodiment the tap water is further supplied via a line 18 which, for preheating of the tap water which has for instance a temperature of 5–15° C., is arranged via a folded heat exchanger 19 in a discharge part 20 for the flue gases. After flowing through the inner pipe 10 of heat exchanger 8 the tap water is guided via coupling piece 21 and line 22 to reservoir 23 for temporary storage thereof, so that hot water is immediately available to the user when a tap is opened. Reservoir 23, which is well insulated in a manner not shown, is provided with an inner sleeve 24 so that incoming tap water is first of all driven in upward direction as according to arrows C and subsequently flows between outer wall 25 of the reservoir and inner sleeve 24 to drain stub 26 for drawing off the tap water (arrow D).

Arranged in the annular interspace of reservoir 23 is a second heat exchanger 27 through which flows the fluid of the central heating installation supplied via lines 28, three-way valve 16 and line 29.

The apparatus according to the present invention is preferably provided in a manner not shown with a control unit which controls three-way valve 16, pump 15 and gas regulation 3. Three-way valve 16 is controlled either to heat the medium in an internal circuit or for use wherein heat must be supplied continuously to the central heating circuit and the feed and discharge line of this central heating circuit are in continuous connection thereto.

Figure 2:
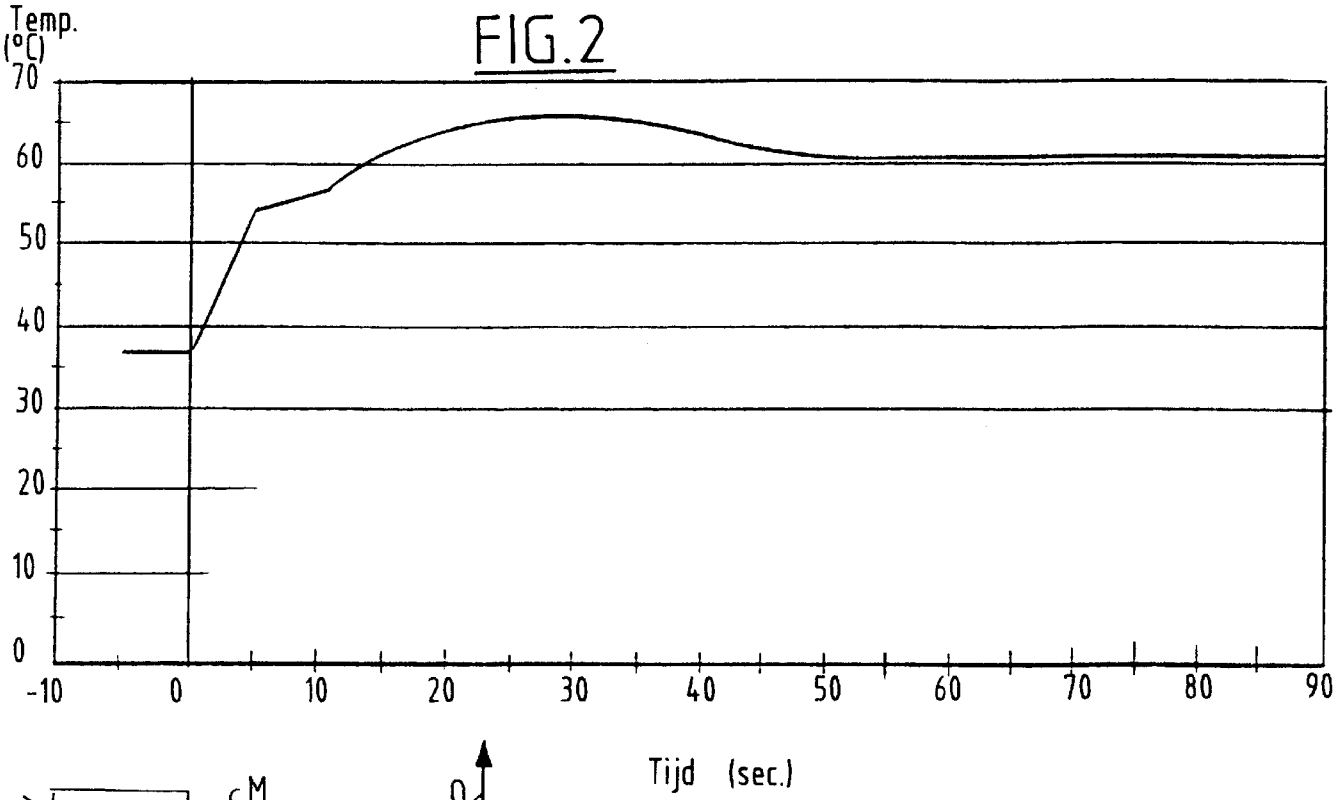
FIG. 2 shows a graph illustrating the operation of the preferred embodiment of FIG. 1.

The curve in the graph of FIG. 2 shows that when tap water is drawn off in a dwelling with a pipe of determined length between draw-off point and apparatus according to the present invention, the temperature is at a level of 60° C. within ±15 seconds and also no longer falls below this level. During this measurement it has been found that it is advantageous to slightly delay starting of the pump for the primary heating fluid, for instance for a duration of 5–15 seconds, or to set it at a lower pumping level when the burner has to be set into operation to supply the demanded amount of heat. Cold water still present in the heat exchanger is thus prevented from entering the reservoir before being heated.

Figure 3:
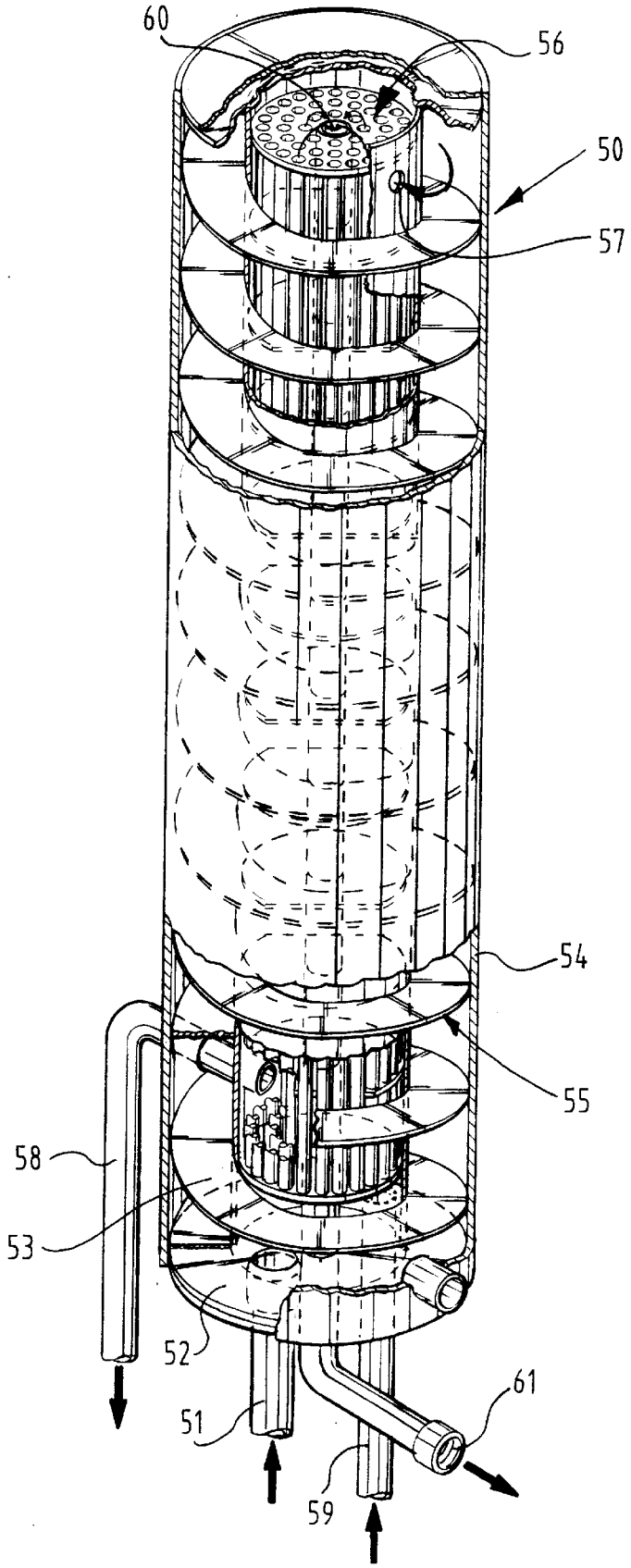
FIG. 3 shows a partly broken-away view in perspective of an alternative embodiment of the reservoir shown in FIG. 1.

In a further preferred embodiment the apparatus according to the present invention is provided with a reservoir 50 (FIG. 3) for tap water which can be manufactured more simply and at lower cost than the reservoir 23 of FIG. 1. The tap water for heating is guided via a feed line 51 on the underside of reservoir 50 into a groove between two successive windings 52 and 53 of a helical plate 55 arranged on an outer jacket 54, so that the supplied tap water is preheated before entering the interior of a heat exchanger 56 via an inlet opening 57. An outlet line 58 on the underside of heat exchanger 56 is connected onto the interior thereof for draining of the heated tap water.

In an alternative embodiment (not shown) the helical plate 55 can be replaced by a plurality of concentric discs arranged one above another and having openings for passage of water.

Heat exchanger 56 comprises a large number of substantially upright pipes which are connected via a distributor (not shown) to a feed line 59 for hot central heating water. At the top the upright pipes debouch into a central return pipe 60 onto which connects a discharge line 61 for the central heating water.

Figure 4:
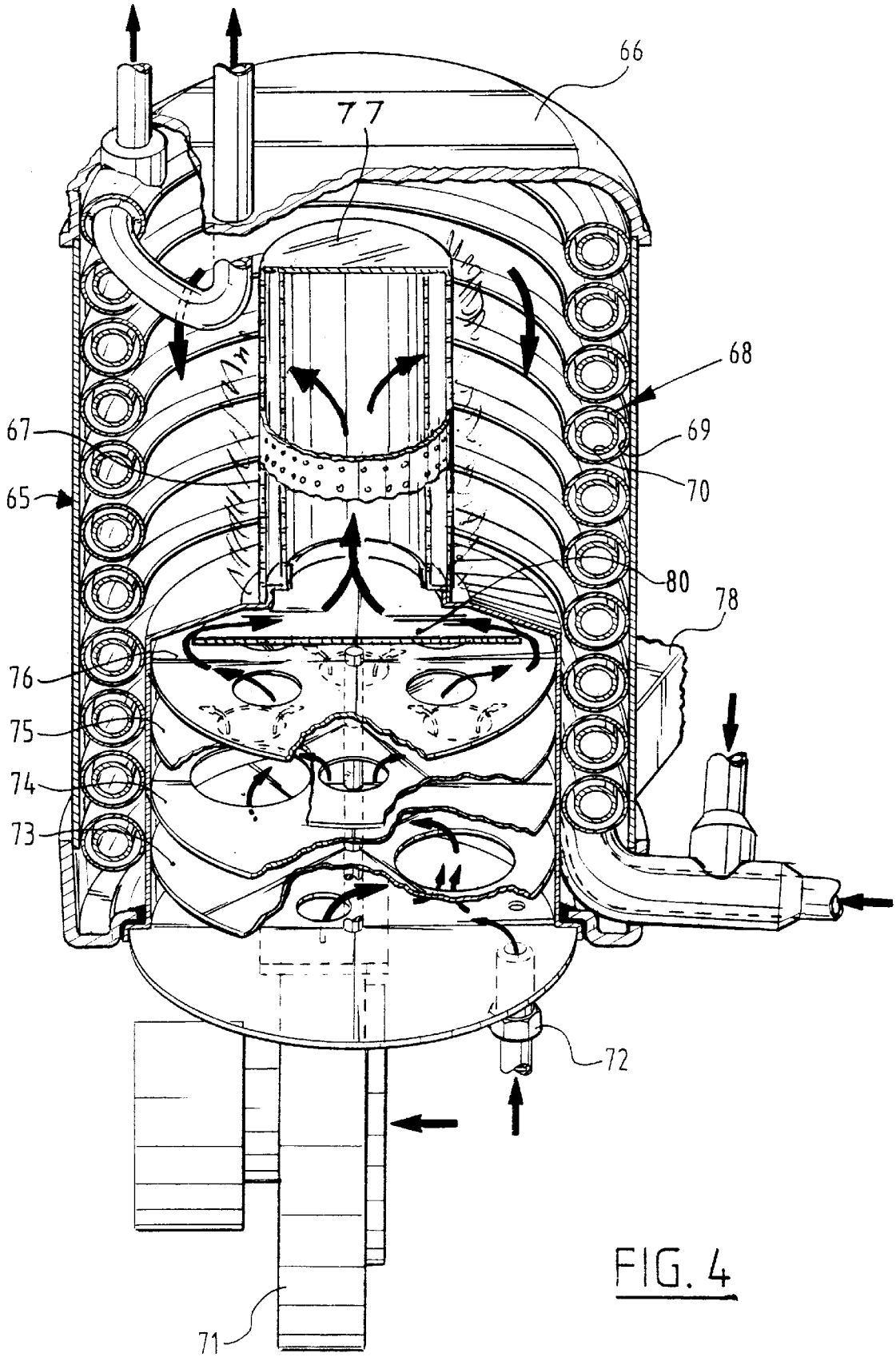
FIG. 4 is a partly sectional and partly broken-away view in perspective of an alternative embodiment of the burner and primary heat exchanger of FIG. 1.

In an alternative embodiment of an apparatus according to the present invention (FIG. 4) a helical heat exchanger 68 is arranged in a space defined by an outer sleeve 65, a cover 66 and an inner sleeve 67, which heat exchanger comprises an outer pipe 69 and an inner pipe 70. In order to increase the combustion efficiency the air supplied via a fan 71 is mixed with gas supplied via a feed connection 72 by means of a plurality of horizontally disposed plates 73, 74, 75, 76 respectively which are provided in each case with passage openings which are in shifted arrangement in successive plates in order to obtain a well mixed, turbulent flow of the mixture combusted in a burner 77. The gases leaving burner 77 are guided along the pipes of heat exchanger 68 and discharged on the underside via an outlet 78 for the flue gases. Due to the good mixing of air and gas a complete combustion of the mixture is achieved whereby the emission of CO and $No_x$ is avoided as far as possible. In order to prevent excessive heating of the inner pipe a closed baffle plate 80 is preferably arranged above the plates 73–76 provided with openings.

Figure 5:
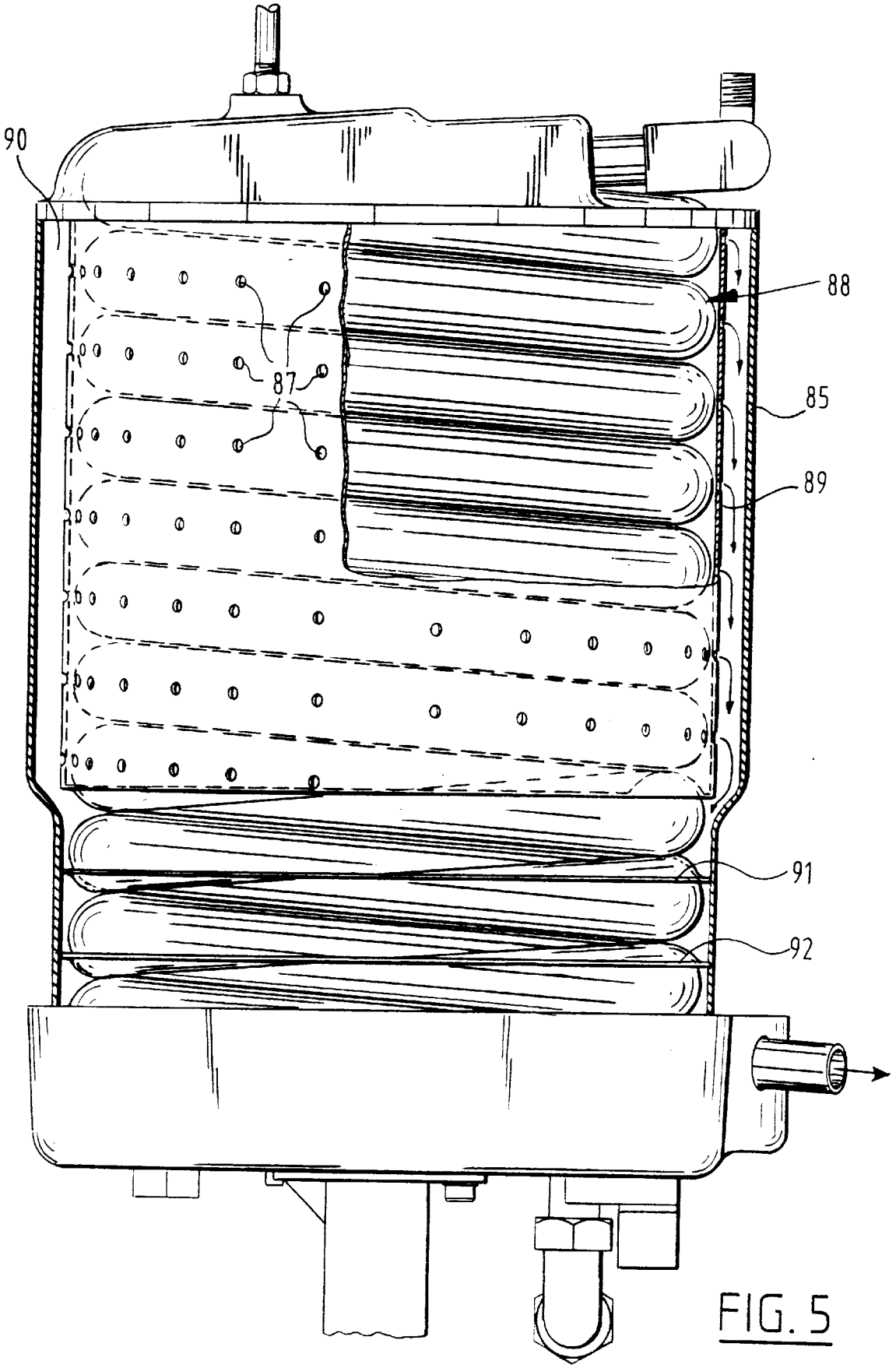
FIG. 5 is a partly broken-away side view of an alternative embodiment of the primary heat exchanger of FIGS. 1 and 4.

Arranged in a further preferred embodiment between an outer jacket 85 (FIG. 5) and a helical pipe 88 is an intermediate jacket 89 of substantially cylindrical form in which openings 87 are arranged in accordance with the pitch of the helical pipe of heat exchanger 88. In a manner not shown the pipe 88 can be provided with fins or plate-like protrusions in order to increase heat transfer. Due to the location of the openings 87 at the position of the centre line of the helical pipe, the flue gases are urged to flow as closely as possible along the periphery of the helical pipe of the heat exchanger before arriving in an interspace 90, along which the flue gases are discharged downward. In order to further increase efficiency, partitions 91, 92 provided with openings are further arranged along the lower helical windings of heat exchanger 88, whereby the flue gases flow further along the heat exchanger.

Figure 6:
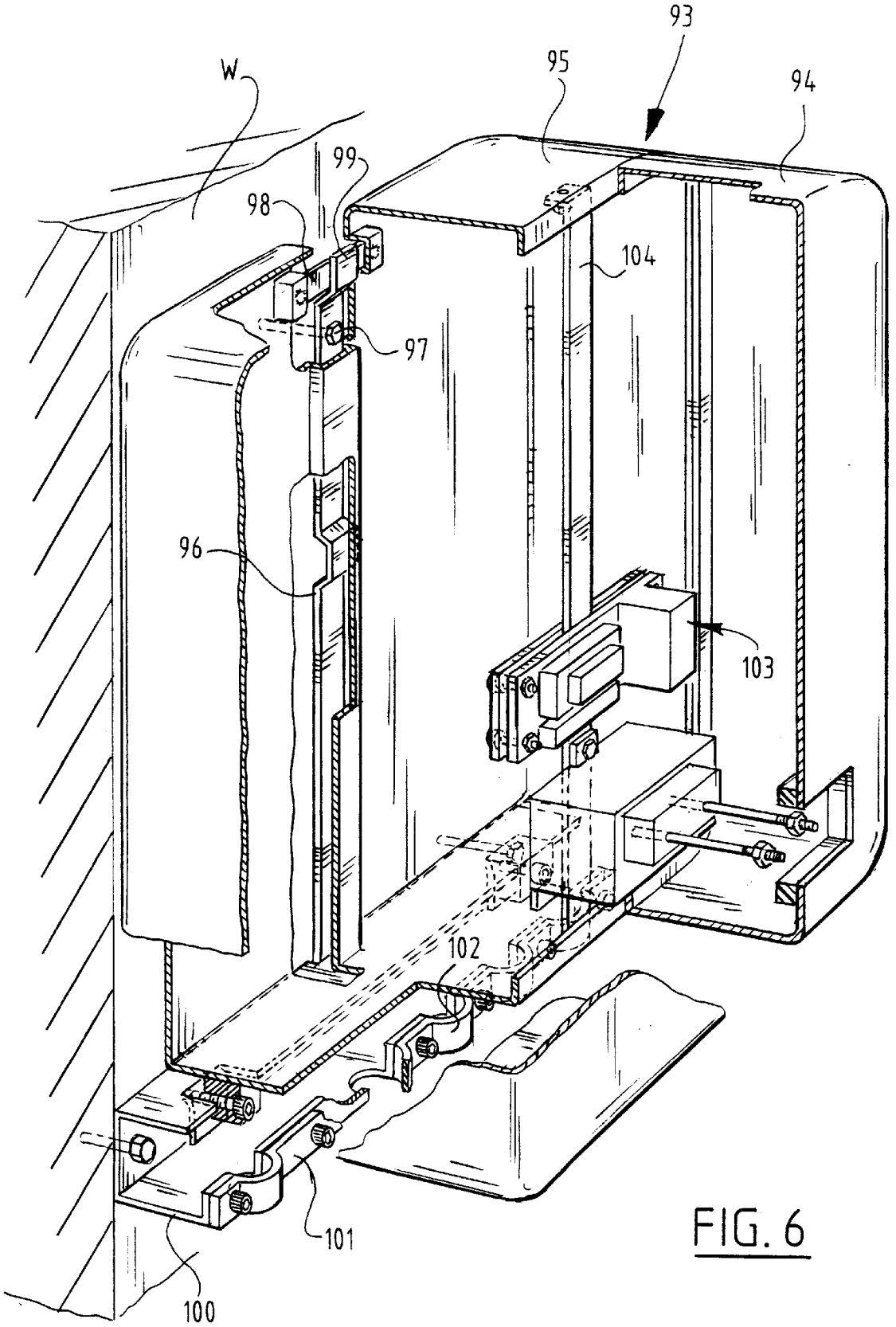
FIG. 6 is a partly broken-away view in perspective of the fixing to a wall of a preferred embodiment of the apparatus according to the present invention.

For installation and servicing operations it is important that the apparatus according to the present invention, which can be embodied very compactly, can be mounted in simple manner on a wall, for instance in a cupboard, while the accessibility to the interior of the cupboard must be ensured. According to a preferred embodiment of the present invention a cupboard 93 (FIG. 6), preferably consisting of a front part 94 which is removable and a rear part 95, is fixed via this rear part to a strip-like plate 96 which is mounted on a wall W using screw bolts such as 97 and suspended therefrom. For this purpose a plate 98 is fixed, preferably welded, to the rear part 95, which plate engages behind a hooked end 99 in strip-like plate 96 and is hung thereon. In addition, the underside of the rear part 95 is supported on a profile 100 of substantially U-shaped cross-section to which the feed and discharge lines for central heating water and tap water can be fixed using clamping brackets 101, 102 etc. The diverse components, such as control electronics 103 and other components (not shown) such as the heat exchangers and the reservoir for the tap water, are preferably arranged on the rear part 95 of cupboard 93 fixed firmly to wall W, for instance by means of brackets 104 placed therein. In another preferred embodiment (not shown) the rear part 95 of the cupboard can be provided on the underside with pins which engage in recesses in bracket 100 whereby cupboard 93 is also prevented from being able to tilt forward because of its weight.

Figure 7:
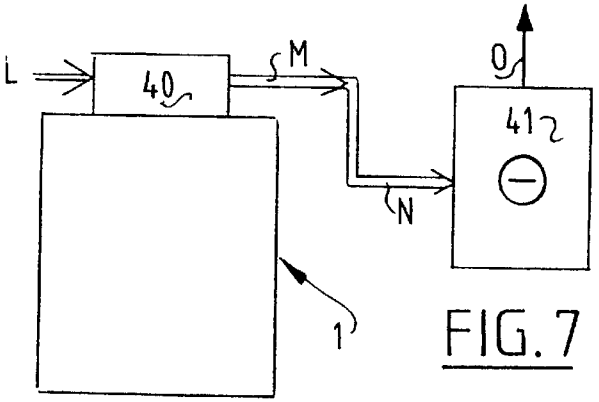
FIG. 7 shows a diagram of a further preferred embodiment for use of the apparatus according to the present invention.

In the embodiment of the present invention of FIG. 7, a further heat exchanger is arranged at the top of the apparatus 1 according to the present invention, which heat exchanger is placed in conducting contact with for instance the discharge part 20 for the flue gases. At the entrance to this further heat exchanger 40 relatively cool air L is introduced, wherein the heated air is carried via arrows M and N respectively into a dryer 41 for drying laundry in energetically responsible manner.

Figure 8:
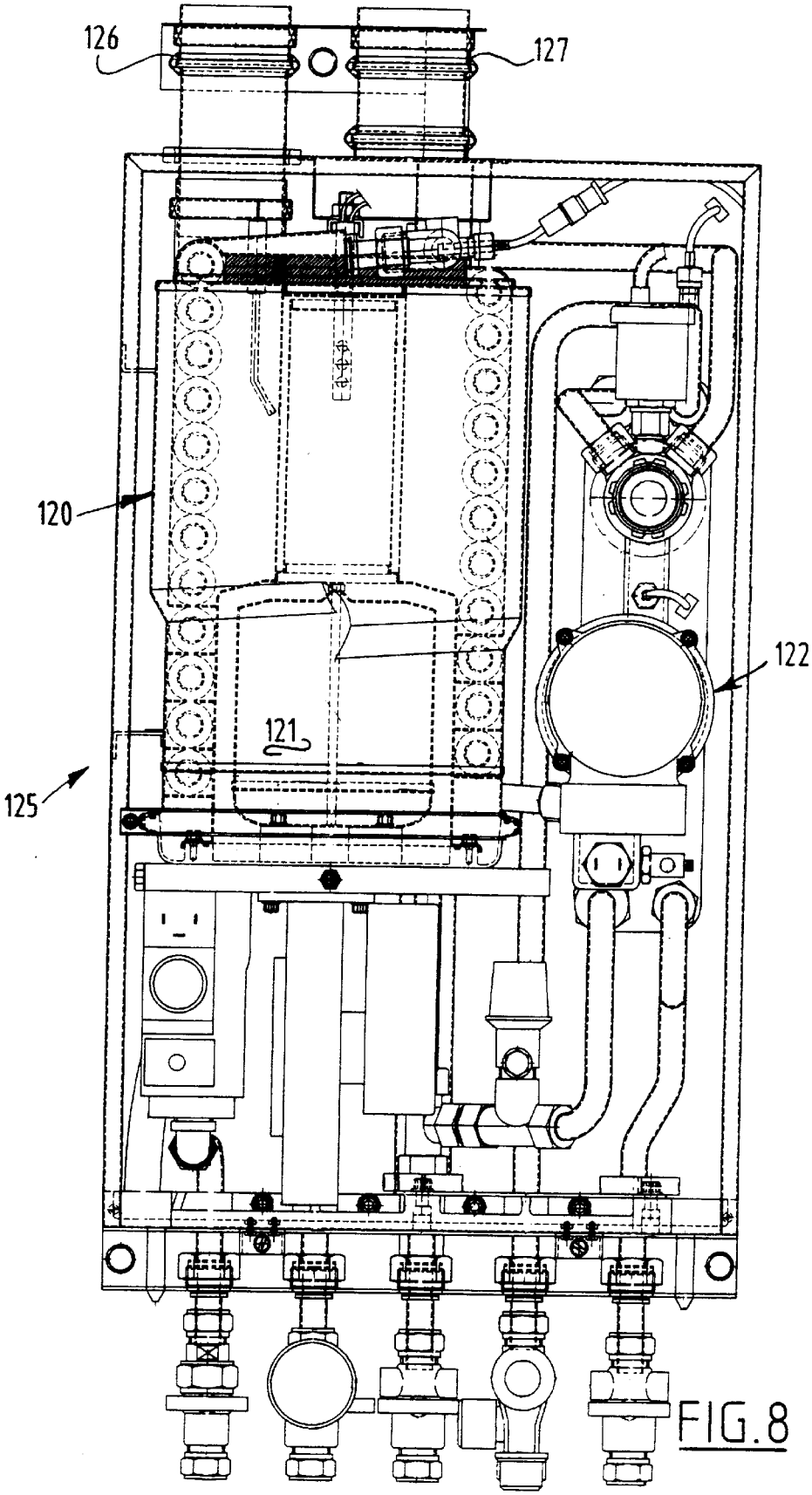
FIG. 8 shows a front view of a further preferred embodiment of the present invention.

In the embodiment according to FIG. 8, in addition to the burner construction 120 (such as that in FIG. 5) with schematically designated mixing means 121, a heat exchanger 122 is arranged instead of a reservoir for tap water, whereby the invention can be embodied in even more compact manner. At the top the apparatus 125 is provided with preferably slidable connecting pieces 126 and 127 for easy connection of the air feed and the discharge of the combustion gases. The diverse connections for central heating water, gas and mains water are arranged at the bottom. These connections are preferably clamped between a formed piece on the cupboard and a counter-piece fixedly screwable thereon so that the diverse components can be assembled in a cupboard in lying position, whereafter the counter-piece is screwed fittingly into place over the connections. This facilitates assembly and installation operations.

Most probably because of the good thermal balance, whereby large thermal differences do not occur in the compact design of the apparatus according to the present invention, it has been found that the emission of $NO_x$ and CO in this appliance according to the present invention have extremely low values. Measurements have shown that the efficiency of the apparatus according to the present invention amounts to theoretically 100%, in any case considerably more than 95%, while the emission of CO and $NO_x$ is very low (maximum ca. 95 ppm (at 32 kW) respectively ca. 13 ppm (at 32 kW)).

Figure 9:
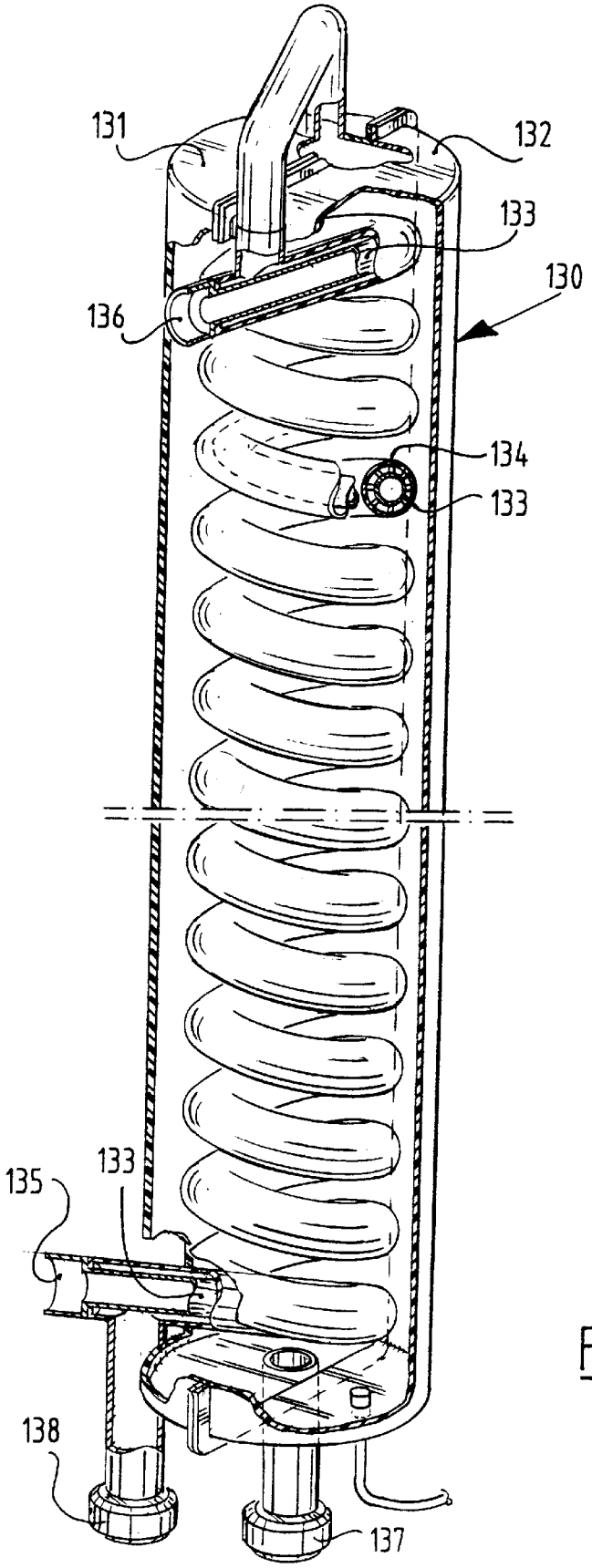
FIG. 9 shows a view in perspective of a further preferred embodiment of a reservoir for hot water for use in an apparatus according to the present invention.

A further preferred embodiment for a so-called draw-off pot for hot water (FIG. 9) is constructed from a substantially cylindrical vessel 130 which can be of metal but which is preferably assembled from two plastic shells respectively 131, 132 which can be fixed releasably to each other with connecting means (not shown) such as bands or screw bolts in order to open and clean the reservoir in the case of lime scale. Arranged in vessel 130 is a helical metal tube 133, preferably of metal, around which is arranged a pipe or hose 134 of for instance thin plastic (wall thickness of for instance less than 1 mm). Via connecting stub 135 hot water is carried out of the heating system into the helical inner pipe 133, while the water is returned to this system at the top via connecting stub 136. The tap water for heating is carried via connecting stub 137 into vessel 130, while that water in the interspace between the plastic hose 134 and the helical inner pipe 133 is guided downward via the top part into connecting stub 138 to which a hot water line is connected. Spacers are arranged in a manner not shown at determined locations between inner pipe 133 and plastic hose 134 in order to prevent the passage for the water to be heated from being blocked. A temperature sensor is likewise arranged in the vessel in a manner not shown close to connecting stub 137, which sensor senses whether the temperature of the water in the vessel falls below for instance 40° C., whereafter hot central heating water must be supplied. The water for heating is first preheated during the upward movement thereof, while it is heated very strongly during the downward movement between helical pipe 133 and plastic hose 134. Because use is made of a plastic hose arranged round the helical inner pipe 133, a heat exchanger is obtained which is extremely favourable in terms of cost, while for the inner pipe use can be made of standard, commercially available elements. The structure is so compact that it can be incorporated in the compact heating appliances described in the foregoing.

The present invention is not limited to the above described preferred embodiments thereof. Many modifications can be envisaged within the scope of the present invention, which is defined by the following claims. An example of such a non-limiting modification is the placing of a second tap water reservoir in the appliance according to the present invention, since space is still available in the inner space thereof and the stable high temperature of the tap water can thereby be ensured even more precisely.

What is claimed is:

1. Apparatus for heating fluid, comprising:

a first fuel supply for supplying fuel;

a second supply for supplying oxidizing agent;

a burner connected for receiving fuel and oxidizing agent and mixing them and for combusting fuel and oxidizing agents after mixing thereof;

a heat exchanger positioned to be heated by flue gases produced by the burner, the heat exchanger comprising a pipe arranged helically around the burner and a jacket provided with openings therethrough, the jacket and its openings being arranged around the helical heat exchanger for enabling exit of flue gases from within to without the jacket past the heat exchanger.

2. Apparatus as claimed in claim 1, wherein the burner comprise a mixer for mixing the fuel and the oxidizing agent.

3. Apparatus as claimed in claim 2, wherein the mixer comprise a plurality of plate parts provided with passage openings.

4. Apparatus as claimed in claim 1, wherein the heat exchanger comprises an inner pipe and an outer pipe extending therearound, wherein the inner pipe is at least partially heated by primary heated fluid flowing between the inner pipe and the outer pipe.

5. Apparatus as claimed in clain 4, further comprising a reservoir for temporarily storing heated water, wherein the reservoir includes a second heat exchanger which is operationally coupled to the heat exchanger.

6. Apparatus as claimed in claim 5, wherein the second heat exchanger in the reservoir is connected to a heating circuit.

7. Apparatus as claimed in claim 4, further comprising a pump with rotation speed regulation, at least one ON/OFF control, wherein the rotation speed is regulated subject to the moment at which tap water is drawn off;

a three-way switch for switching the fist heat exchanger between a first position in which it is connected to the heating circuit and a second position in which it is connected to the second heat exchanger.

8. Apparatus as claims in claim 1, further comprising a further heat exchanger for preheating tap water using the flue gases.

9. Apparatus as claims in claim 7, further comprising a pump with rotation speed regulation, at least one ON/OFF control, wherein the rotation speed is regulated subject to the moment at which tap water is drawn off.

10. Apparatus as claimed in claim 9, further comprising a control unit for temporarily interrupting or reducing the pumping action of the pump.

11. Apparatus as claimed in claim 1, wherein the heat exchanger is arranged in heat-conducting contact with the top part of the apparatus and is provided with an inlet for infeed of medium for heating and an outlet for heated medium.

12. Apparatus as claimed in claim 1, further comprising hanging means for hanging the apparatus.

13. Apparatus as claimed in claim 1, further comprising a reservoir for temporarily storing heated water, a primary helical pipe in the reservoir and an outer pipe around the primary pipe.

14. Apparatus as claimed in claim 13, wherein the reservoir is constructed from two or more releasably connectable shell parts.

15. The apparatus of claim 1, further comprising an outerjacket, an intermediate jacket between the helical heat exchanger pipe and the outer jacket; and the openings are through the intermediate jacket whereby flue gases pass out the intermediate jacket and pass between the other jacket and the intermediate jacket.

16. The apparatus of claim 15, wherein the intermediate jacket is substantially cylindrical, and the openings through the intermediate jacket are arranged according to the pitch of the helical shape of the heat exchanger pipe.

17. The apparatus of claim 1, wherein the jacket is substantially cylindrical, and the openings through the jacket are arranged according to the pitch of the helical shape of the heat exchanger pipe.

* * * * *